US012163317B1

(12) United States Patent
Ware

(10) Patent No.: US 12,163,317 B1
(45) Date of Patent: Dec. 10, 2024

(54) HAWK FAUCET COVER

(71) Applicant: Clifford Edward Ware, Columbus, GA (US)

(72) Inventor: Clifford Edward Ware, Columbus, GA (US)

( * ) Notice: Subject to any disclaimer, the term of this patent is extended or adjusted under 35 U.S.C. 154(b) by 0 days.

(21) Appl. No.: 18/345,272

(22) Filed: Jun. 30, 2023

(51) Int. Cl.
*E03B 7/12* (2006.01)

(52) U.S. Cl.
CPC ..... *E03B 7/12* (2013.01)

(58) Field of Classification Search
CPC . E03B 7/12; E03B 7/095; E03B 9/027; E03B 9/06; F16K 27/12; Y10T 137/7062; Y10T 137/7036; Y10T 137/698
See application file for complete search history.

(56) References Cited

U.S. PATENT DOCUMENTS 1,158,631 A * 11/1915 Caldwell ..... F16K 35/10 70/180
2,990,846 A * 7/1961 Rives ..... F16K 43/00 137/377
4,301,828 A * 11/1981 Martin, Jr. ..... B60K 15/05 137/381
4,678,003 A * 7/1987 Griffin ..... F16K 35/10 137/382
5,614,119 A * 3/1997 Ollis ..... F16K 27/12 392/416
6,889,394 B2 * 5/2005 Guillen ..... A47K 1/00 137/382
10,301,072 B1 * 5/2019 Dent ..... B65D 11/20
11,359,358 B1 * 6/2022 Timms ..... E03B 9/025
2005/0247009 A1 * 11/2005 Vagedes ..... E03B 7/10 52/698

* cited by examiner

*Primary Examiner* — Reinaldo Sanchez-Medina

(57) ABSTRACT

An apparatus for covering outdoor faucets including a mounting plate connected to outside wall with four screws that contours to the shape of the exterior wall, a bottom flap connected to mounting plate that allows access to faucet nozzle when in the open position and a plastic faucet hood cover connected to the upper part of the mounting plate that provides cover for faucet water control handle when in the closed position.

2 Claims, 6 Drawing Sheets

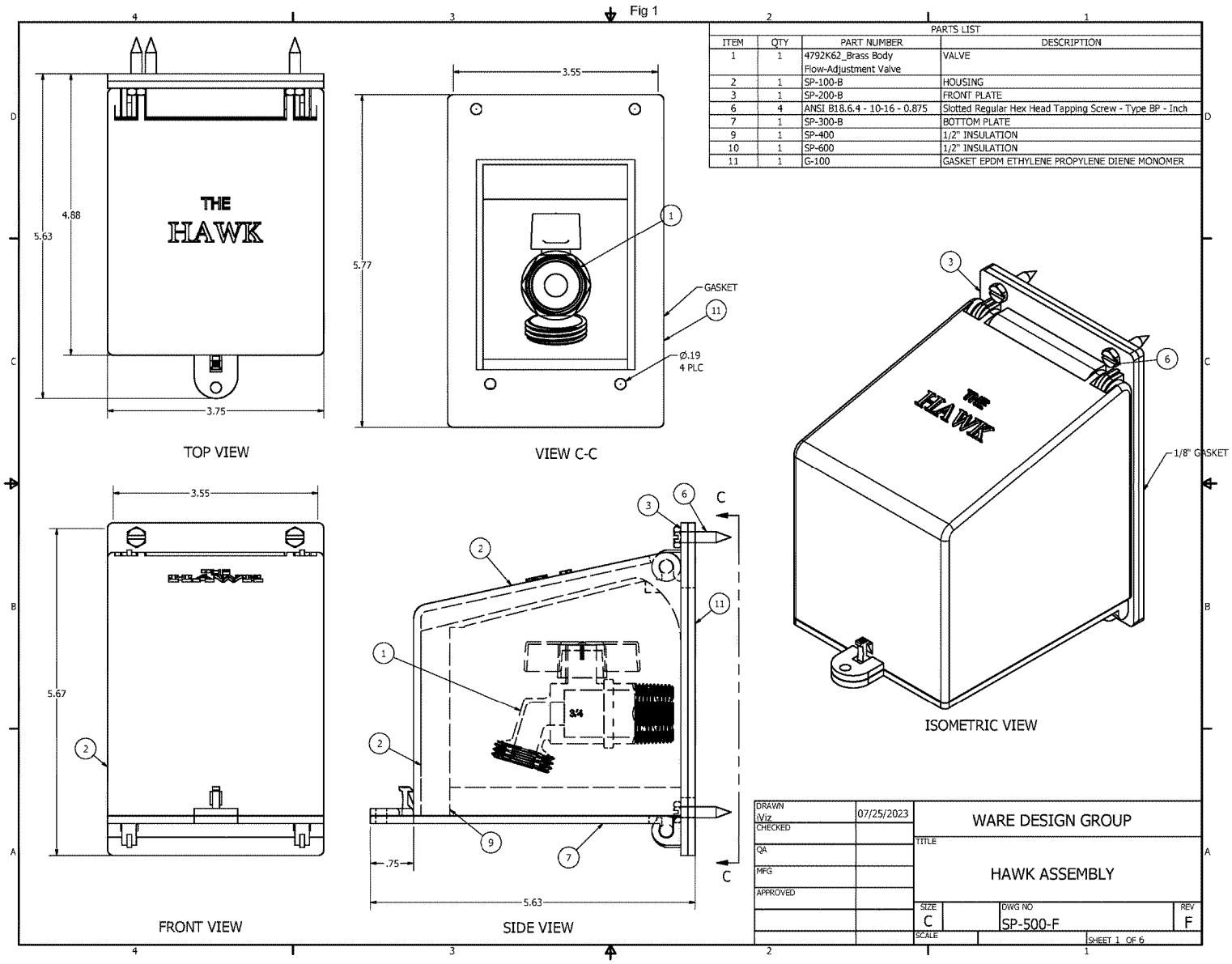
Fig 1
PART'S LIST
ITEM | QTY | PART NUMBER | DESCRIPTION
1 | 1 | 4792K62_Brass Body | VALVE
Flow-Adjustment Valve
2 | 1 | SP-100-B | HOUSING
3 | 1 | SP-200-B | FRONT PLATE
6 | 4 | ANSI B18.6.4 - 10-16 - 0.875 | Slotted Regular Hex Head Tapping Screw - Type BP - Inch
7 | 1 | SP-300-B | BOTTOM PLATE
9 | 1 | SP-400 | 1/2" INSULATION
10 | 1 | SP-600 | 1/2" INSULATION
11 | 1 | G-100 | GASKET EPDM ETHYLENE PROPYLENE DIENE MONOMER
1/8" GASKET
ISOMETRIC VIEW
WARE DESIGN GROUP
HAWK ASSEMBLY
DRAWN JVZ 07/25/2023
CHECKED
QA
MFG
APPROVED
TITLE
SIZE C
DWG NO SP-500-F
REV F
SCALE
SHEET 1 OF 6
GASKET
Ø.19 4 PLC
3.55
5.77
VIEW C-C
5.63
.75
SIDE VIEW
4.88
5.63
3.75
TOP VIEW
3.55
5.67
FRONT VIEW

HAWK FAUCET COVER

BACKGROUND OF THE INVENTION

The present invention is in the field of home improvement and particularly to the freeze protection of outdoor plumbing.

SUMMARY OF THE INVENTION

In one embodiment of the invention an apparatus for covering outdoor faucets is provided comprising a mounting plate connected to outside wall with four screws and contours to the shape of the exterior wall, a bottom flap connected to mounting plate that allows access to faucet's nozzle when in the open position and a plastic faucet hood cover connected to the upper part of the mounting plate that provides cover for water control handle when in the closed position.

OBJECT OF THE INVENTION

In one embodiment the faucet cover has ½" thick foam rubber insulation attached to the back of the mounting plate, the top of the bottom flap and the interior of the hood cover for freeze protection.

FIELD OF THE INVENTION

This invention is in the field of outdoor plumbing freeze and UV protection.

Brief Statement of the Prior Art

No prior art has been identified.

BRIEF DESCRIPTION OF DRAWINGS

FIG. 1 is an overall view of the completely assembled outdoor faucet cover with cross sections side and back.

DETAILED DESCRIPTION

Figure 2:
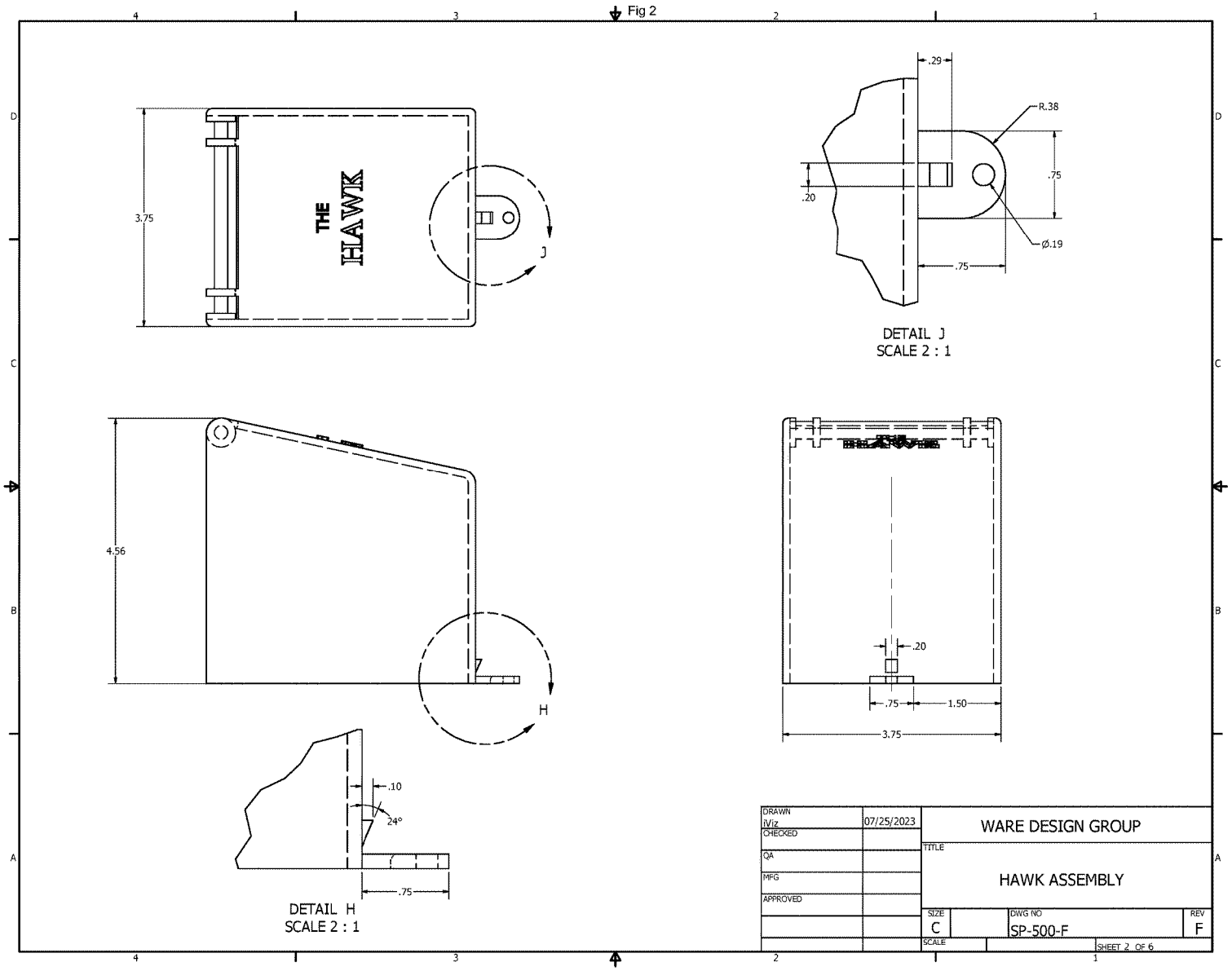
FIG. 2 is a block diagram of the housing component item (2) according to the embodiment of the present invention.

The inventor provides a unique design for year-round freeze and UV protection for outdoor faucets. The present inventor is described in enabling detail in the following examples, which may represent more the one embodiment of the present invention. Any broken line illustration of environmental structure in the drawing is not part of the design sought to be patented.

FIG. 1 is an overall view of a completely assembled outdoor faucet cover, according to an embodiment of the present invention. The Hawk is in this example an outdoor faucet cover that produces commercially for the consumer market. FIG. 1 shows the top, front, back and side views of the Hawk with an intersecting cross-view.

The Hawk is composed of three major parts the mounting plate, the bottom flap, and the housing cover. In this example when completely assembled and attached, the Hawk provides freeze and UV protection for the covered faucet. The top view in FIG. 1 shows item (3) the mounting plate with ½" thick gasket that attaches to the home with item (6) 4 slotted regular hex head tapping screws, 1" long. The top view also shows the 0.75" diameter tab with a 0.30" rectangular opening for item (7) bottom flap with tab. This front view in this embodiment shows item (7) the bottom flap with 0.25" wide, 0.50" tall tab inserted into item (2) housing to connect the two components. In this example the side view shows the cross-section view of item (1) a ¾" faucet valve extended from the wall, securely enclosed with 0.50" thick insulation item (9), assembled and mounted, Hawk outdoor faucet cover.

The C-C view shows the behind the product view of item (1) the ¾ diameter faucet valve encased with item (11) 0.50" thick EPDM foam rubber, gasket and item (3) mounting plate.

When completely assembled in one embodiment, The Hawk Outdoor Faucet cover provides freeze protection during winter months and provides UV protection year-round.

FIG. 2 is a block diagram of the housing unit item (2) of FIG. 1 according to the embodiment of the present invention. FIG. 2 shows an elevated top and side view of the housing unit item (2). The housing unit measures 4.56" tall, 3.75" wide and 5.24" long.

The housing unit item (2) in this example is composed of 0.13" thick HDPE plastic and has a 0.75" diameter tab with a 0.19" diameter locking hole as described in detail (J). The housing unit item (2) in this example provides UV protection to seals and gaskets inside faucet.

Figure 3:
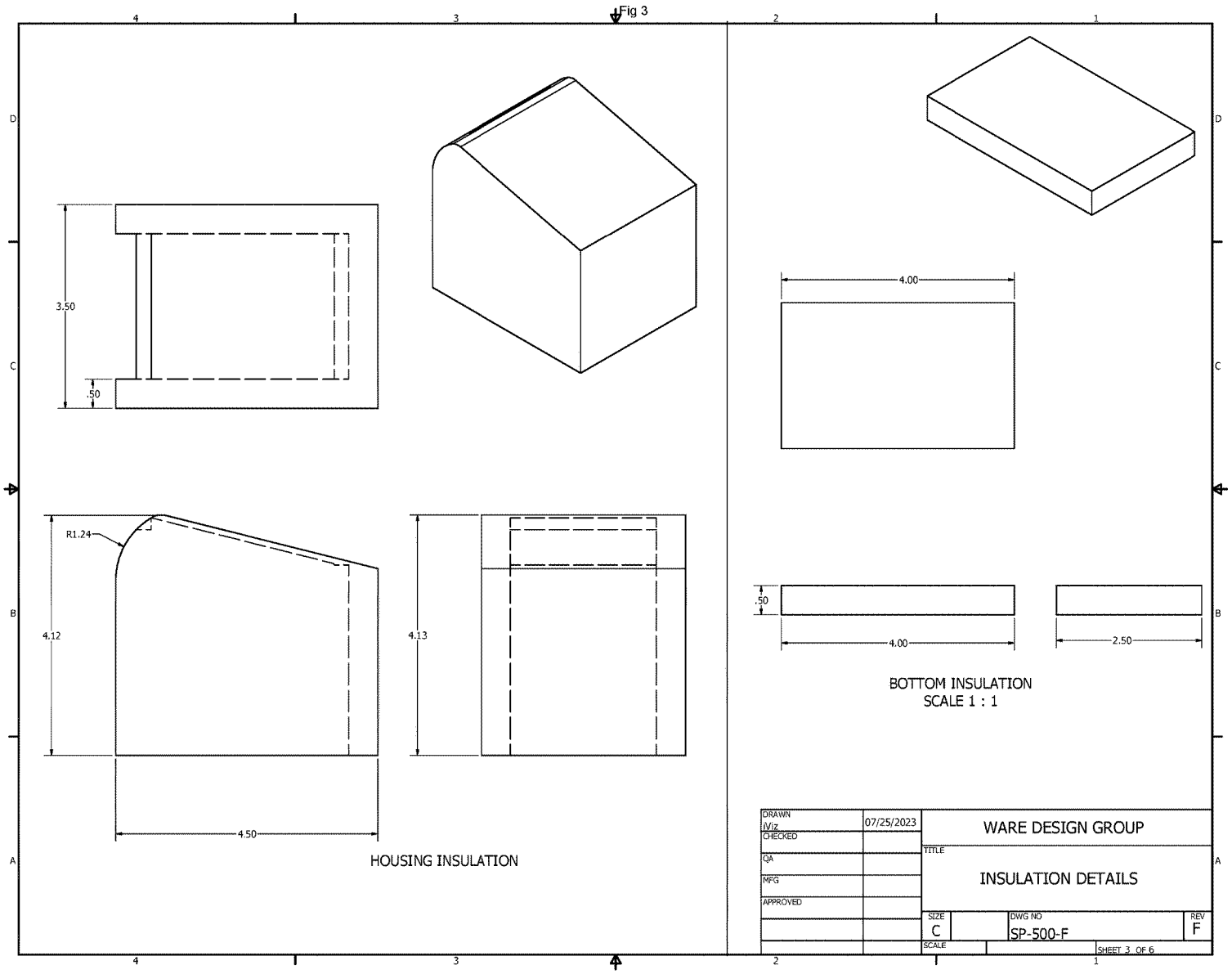
FIG. 3 is a perspective view of the foam rubber insulation of the housing unit item (2) and the bottom flap item (7) according to the embodiment of the present invention.

FIG. 3 is a perspective view of the 0.50" thick EPDM foam rubber insulation for the interior of housing unit item (2) and bottom flap item (7) of FIG. 1. In this example the housing unit item (2) insulation measures 0.50" thick, 3.50" wide, 4.32" tall and 4.50" long and is attached to the interior of housing unit item (2) with adhesive. The insulation for the bottom flap item (7) is 0.50" thick and measures 4.50" long and 2.50" wide and is attached to bottom flap item (7) with peel and stick adhesive.

Figure 4:
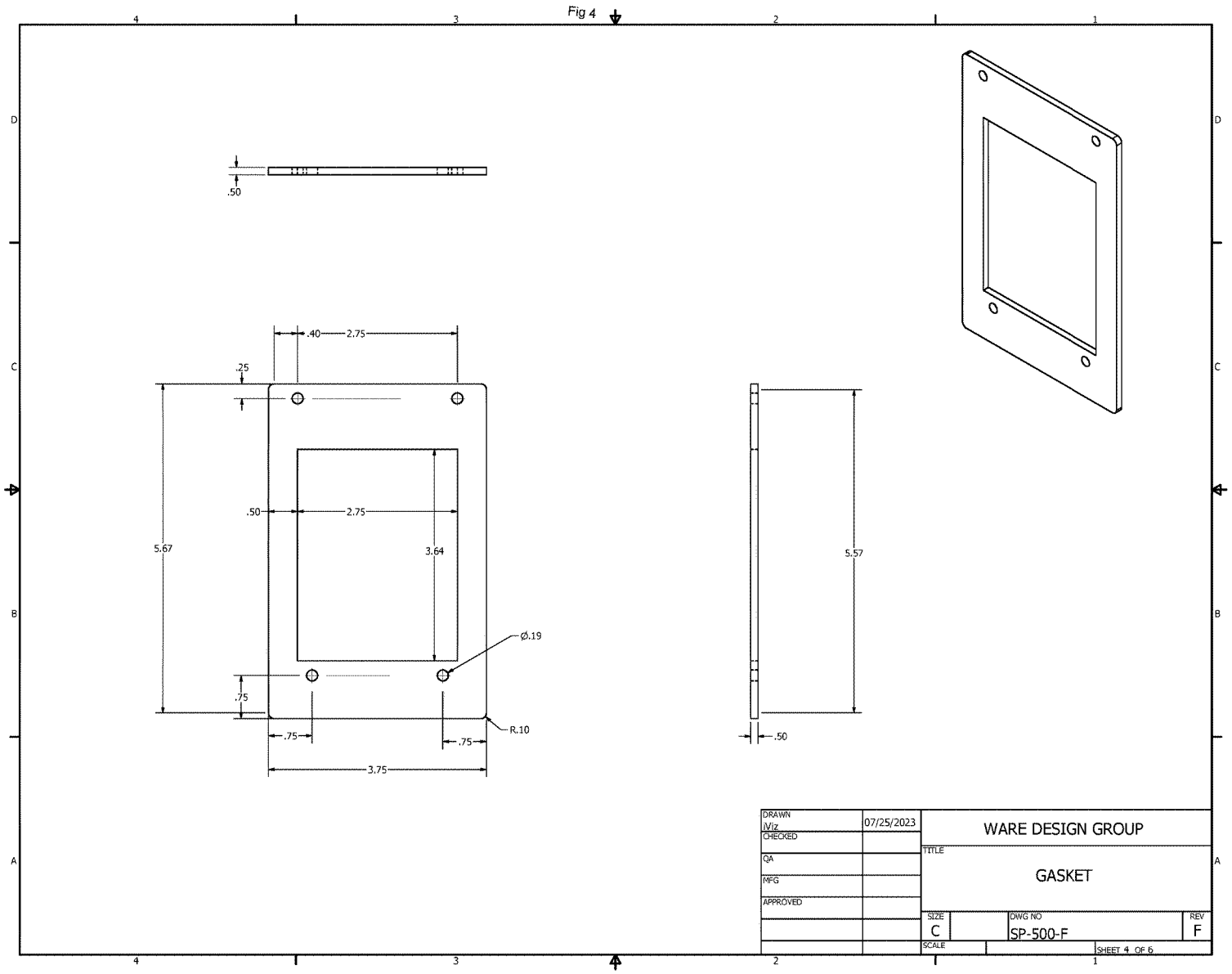
FIG. 4 is a perspective view of the foam rubber gasket of the mounting plate item (3) according to the embodiment of the present invention.

FIG. 4 is a perspective view of the foam rubber gasket of the mounting plate item (3) of FIG. 1 according to the embodiment of the present invention. In this example the 0.50" thick EPDM foam rubber mounting gasket measures 3.75" wide and 5.67" tall. The gasket has an opening that measures 2.75" wide and 3.64" tall to accommodate faucet valve item (1) FIG. 1 according to the embodiment of the present invention.

Figure 5:
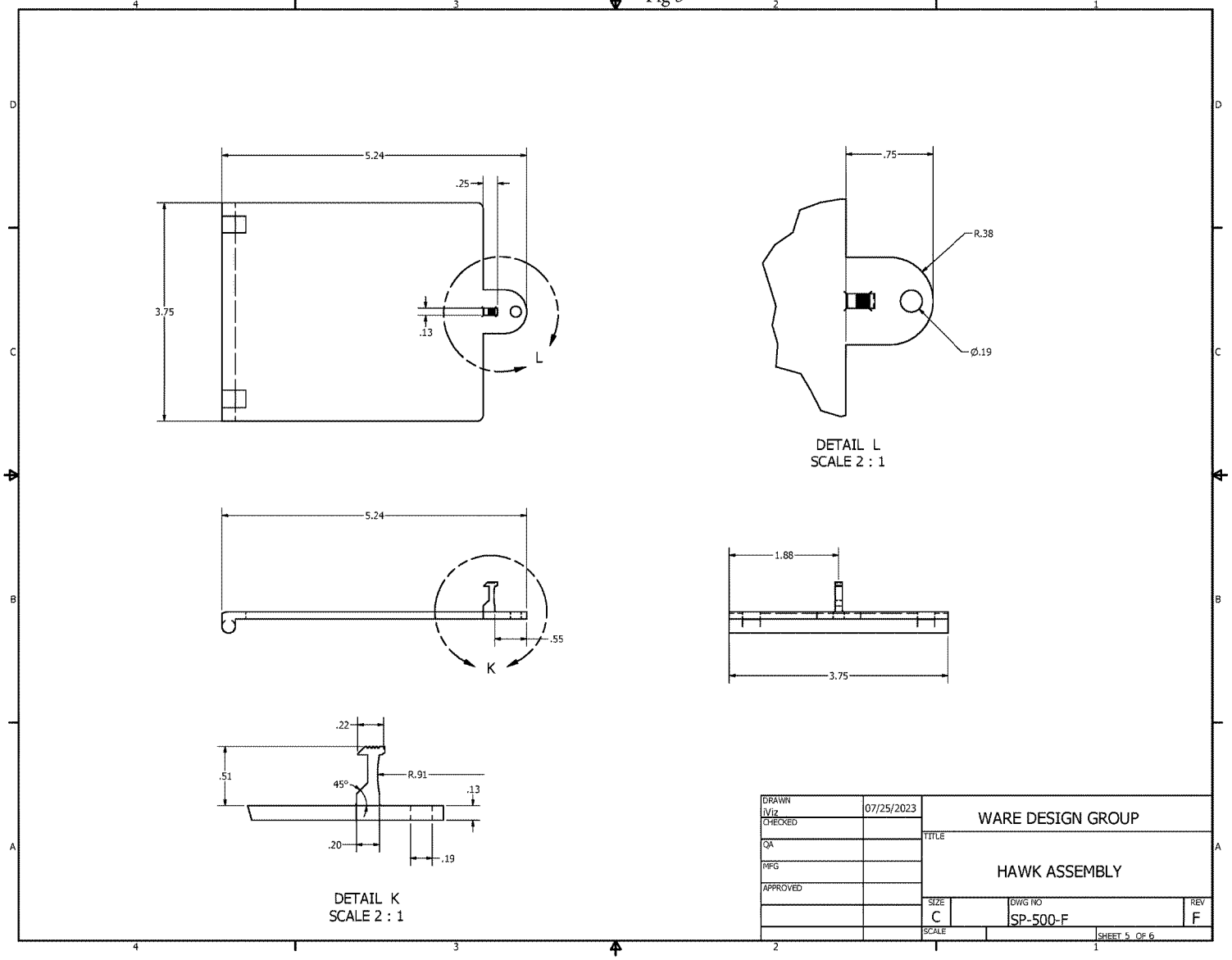
FIG. 5 is a block diagram of the bottom flap component of FIG. 1 according to the embodiment of the present invention.

FIG. 5 is a block diagram of the bottom flap component item (7) of FIG. 1 according to the embodiment of the present invention. The bottom flap is composed of 0.13" thick HDPE plastic and measures 3.75" wide and 5.24" long. In this example the bottom flap item (7) has a 0.75" diameter tab (detail L) with a 0.51" high 0.25" with plastic locking clip (detail K) that fits through the 0.30" opening on housing unit item (2) and clips over the 0.10" ridge on front of housing unit item (2). The 0.75" diameter tab also has 0.19" diameter hole for key lock.

Figure 6:
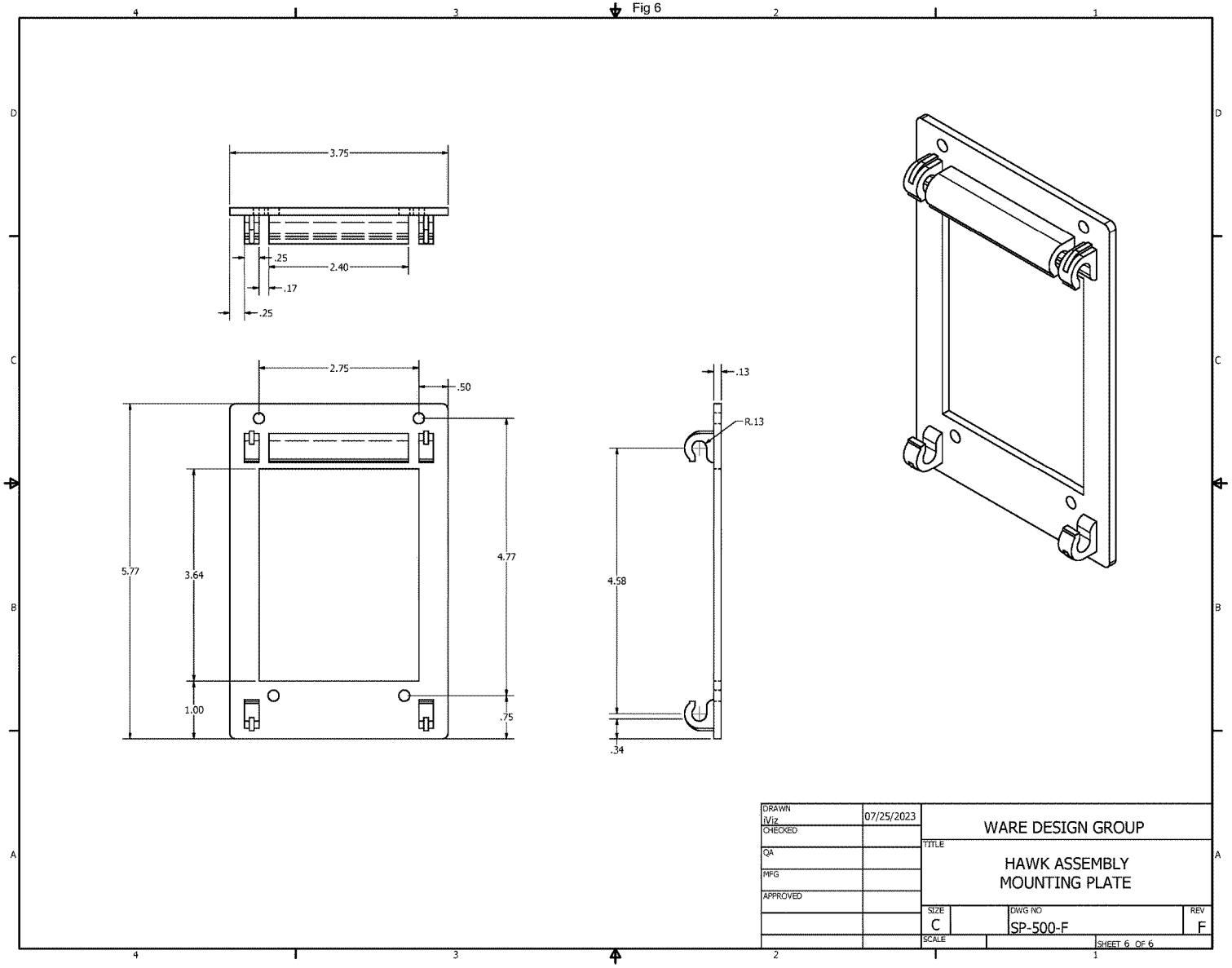
FIG. 6 is a block diagram of the mounting plate component of FIG. 1 according to the embodiment of the present invention.

FIG. 6 is a block diagram of the mounting plate component item (3) of FIG. 1 according to the embodiment of the present invention. The mounting plate is 0.13" thick and measures 3.75" wide and 5.77" high. The mounting plate item (3) has a 2.75" wide 3.64" high opening cut in the middle, to line up with the opening on back side of the housing unit item (2). In this example the mounting plate item (3) has four 0.25" wide 0.13" diameter "C" clamps located on all four corners of the mounting plate item (3) for attaching the housing unit item (2) and bottom flap item (7) according to the embodiment of the present invention. The mounting plate item (3) also has an additional 2.40" long 0.13" diameter "C" clamp located on the top center to attach housing unit item (2). The mounting plate item (3) also has four 0.19" holes located on the corners to attach mounting plate item (3) to existing outer structures. It will be apparent to one with skills in the art, that the Hawk outdoor faucet cover of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

The invention claimed is:

1. A plastic cover for protecting an outdoor faucet connected on an exterior wall of a structure, said cover comprising:

a mounting plate configured to attach to the exterior wall, the mounting plate including a upper section, a lower section, and an opening in the middle configured to surround the outdoor faucet, wherein the upper section and the lower section each have a clamping component;

a plastic hood cover including a top end and a bottom end, wherein the top end has a first cylindrical post configured to snap into the clamping component of the upper section to pivot the plastic hood cover up and down, wherein the bottom end has a first projecting tab extending away from the mounting plate and including at least one opening within the first projecting tab;

a bottom flap including a first end and an opposite second end, wherein the first end has a second cylindrical post configured to snap into the clamping component of the lower section to pivot the bottom flap up and down, wherein the second end has a second projecting tab extending away from the mounting plate, the second projecting tab including an opening and a plastic locking clip extending toward the first projecting tab, the plastic locking clip configured to fit through the at least one opening of the first projecting tab and clip onto the first projecting tab to connect the first and second projecting tabs; and wherein the outdoor faucet is entirely enclosed by the plastic hood cover and the bottom flap when the first and second projecting tabs are connected.

2. The cover according to claim 1, further comprising: a thick foam rubber gasket attached to a back of the mounting plate, and a thick foam rubber insulation attached to a top of the bottom flap and an interior of the plastic hood cover.

* * * * *